US008371845B2

(12) United States Patent
Wakeman

(10) Patent No.: US 8,371,845 B2
(45) Date of Patent: Feb. 12, 2013

(54) TORCH WITH INTEGRATED FLASHBACK ARRESTOR

(75) Inventor: Robert W. Wakeman, Watertown, SD (US)

(73) Assignee: Illinois Tool Works Inc., Glenview, IL (US)

( * ) Notice: Subject to any disclaimer, the term of this patent is extended or adjusted under 35 U.S.C. 154(b) by 2136 days.

(21) Appl. No.: 10/285,012

(22) Filed: Oct. 31, 2002

(65) Prior Publication Data

US 2004/0086819 A1 May 6, 2004

(51) Int. Cl.
*F23D 14/82* (2006.01)

(52) U.S. Cl. ..... 431/346; 266/48; 266/904; 239/424.5; 239/419.3

(58) Field of Classification Search ..... 431/346, 431/344; 266/48, 77, 904; 48/192; 239/424.5, 239/419.3, 424, 422; 222/189.1
See application file for complete search history.

(56) References Cited

U.S. PATENT DOCUMENTS

| | | | | | |
|---|---|---|---|---|---|
| 713,421 | A | * | 11/1902 | Fouche | 431/346 |
| 1,044,651 | A | * | 11/1912 | Harris | 431/346 |
| 2,417,670 | A | | 3/1947 | Anthes | |
| 2,618,539 | A | * | 11/1952 | Conta et al. | 431/346 |
| 4,431,167 | A | | 2/1984 | Clarke | |
| 4,664,621 | A | | 5/1987 | Sugisaku et al. | |
| 4,812,610 | A | * | 3/1989 | Moore | 266/48 |
| 5,392,825 | A | | 2/1995 | Mims et al. | 137/614.2 |
| 5,407,348 | A | | 4/1995 | Mims et al. | 431/346 |
| 5,497,620 | A | | 3/1996 | Stobbe | |
| 5,676,712 | A | | 10/1997 | Anderson | 48/192 |
| 5,772,954 | A | * | 6/1998 | Edenfield | 266/48 |
| 5,882,437 | A | * | 3/1999 | Dixon et al. | 266/48 |
| 5,927,312 | A | | 7/1999 | Dryden et al. | 137/1 |
| 6,726,471 | B2 | * | 4/2004 | Parkin et al. | 431/346 |
| 2003/0096207 | A1 | | 5/2003 | Parkin et al. | 431/346 |

FOREIGN PATENT DOCUMENTS

| | | |
|---|---|---|
| FR | 1448292 | 8/1966 |
| JP | 6082016 A | 3/1994 |
| JP | 8108268 A | 4/1996 |
| JP | 2879315 B2 | 4/1999 |

* cited by examiner

*Primary Examiner* — Jiping Lu
(74) *Attorney, Agent, or Firm* — Fletcher Yoder P.C.

(57) ABSTRACT

A head-mountable flashback arrestor for a gas torch having body, head, and tip sections. The head-mountable flashback arrestor may be disposed in a variety of gas torches, such as cutting torches, welding torches, heating torches, and so forth. The flashback arrestor also may embody a variety of filtering mechanisms, such as a porous metal structure. For example, the porous metal structure may be sintered from a metal particulate, such as a stainless steel powder, to form a non-linear or random flow pattern.

18 Claims, 3 Drawing Sheets

TORCH WITH INTEGRATED FLASHBACK ARRESTOR

BACKGROUND OF THE INVENTION

The present technique relates generally to torch systems, and more particularly, to flashback arrestors for gas torches. The present technique specifically provides a gas torch having a head-mounted flashback-arresting filter, such as a porous metal insert.

In torch systems, such as gas welding and cutting torches, the undesirable backflow of a fuel-oxygen mixture and heating affects may cause a flame to propagate back into the torch system. This inward flame propagation is generally termed flashback. For example, if the gas torch is improperly lit or it is not purged after the depletion of fuel or oxygen, then there is a potential risk of mixed fuel and oxygen being forced back into the gas torch. If an ignition source is subsequently introduced to this fuel-oxygen mixture, then a flame front may propagate back through the tip, head, and body sections of the gas torch and potentially further into the torch system. The internal flame front generally accelerates through the torch system until it is extinguished or until it no longer has an adequate fuel-oxygen mixture to burn. The risks of damage and harm to the user also generally increase as the internal flame front propagates further into the torch system.

Accordingly, a technique is needed for arresting flashback near the tip section of the gas torch.

SUMMARY OF THE INVENTION

The present technique provides a head-mountable flashback arrestor for a gas torch having body, head, and tip sections. The head-mountable flashback arrestor may be disposed in a variety of gas torches, such as cutting torches, welding torches, heating torches, and so forth. The flashback arrestor also may embody a variety of filtering mechanisms, such as a porous metal structure. For example, the porous metal structure may be sintered from a metal particulate, such as a stainless steel powder, to form a nonlinear or random flow pattern.

BRIEF DESCRIPTION OF THE DRAWINGS

The foregoing and other advantages and features of the invention will become apparent upon reading the following detailed description and upon reference to the drawings in which.

DETAILED DESCRIPTION OF SPECIFIC EMBODIMENTS

Figure 1:
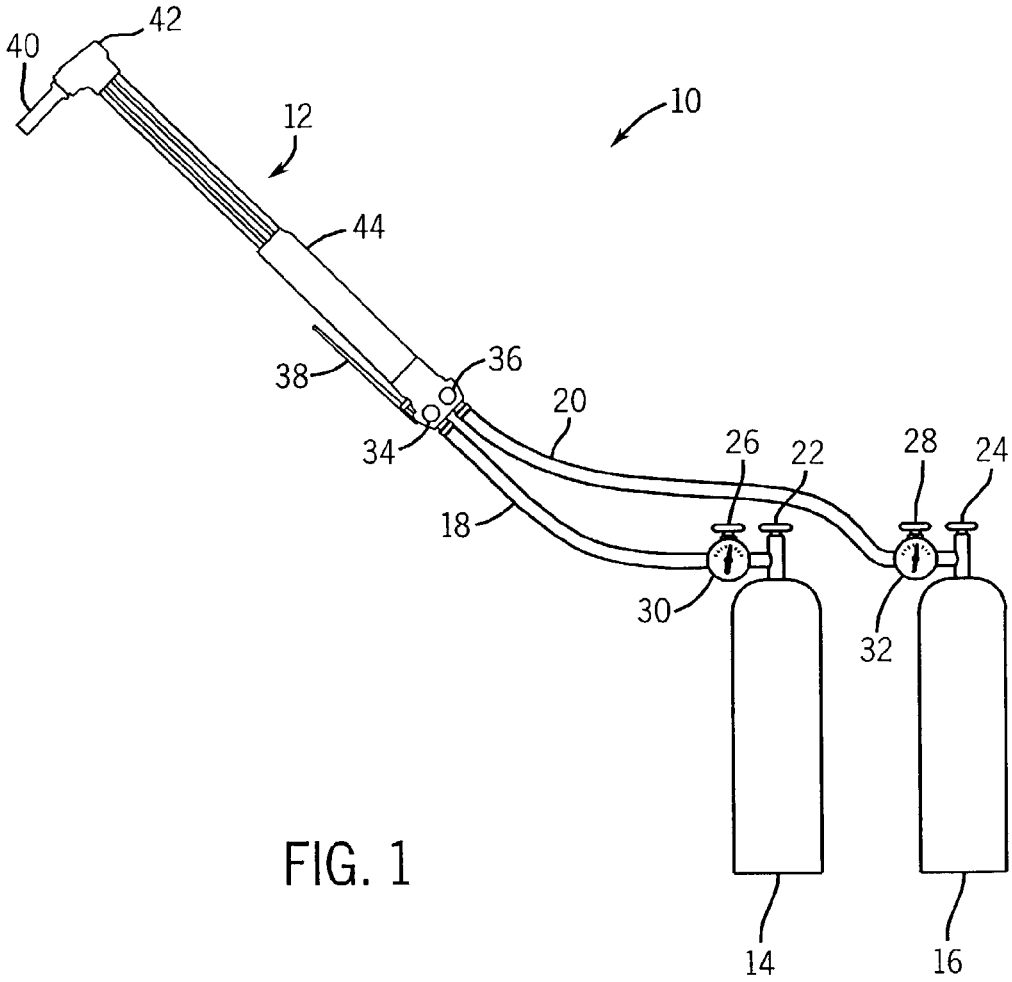
FIG. 1 is perspective view of an exemplary gas torch system of the present technique.

As described in detail below, the present technique provides a system and method for arresting flashback in a torch system 10, such as illustrated in FIG. 1. The illustrated torch system 10 includes a gas torch 12 coupled to oxygen and fuel supplies 14 and 16 via oxygen and fuel supply lines 18 and 20, respectively. In the illustrated embodiment, the gas torch 12 is configured as a handheld cutting torch. However, the gas torch 12 may comprise a welding torch, a cutting torch, a general heating torch, or any other desired torch configuration. The torch system 10 also may comprise an automated positioning system, such as a computer controlled robotic arm. The torch system 10 also may include one more heating mechanisms to preheat the oxygen and fuel being supplied to the gas torch 12. In any of these configurations, the torch system 10 of the present technique has an integral flashback arrestor disposed in the head of the gas torch 12, such that flashback is arrested near the tip of the gas torch 12.

The torch system 10 also may have a variety of valves, pressure regulators, pressure gauges, and flow control mechanisms to facilitate the delivery of the oxygen and fuel to the gas torch 12. For example, the oxygen and fuel supplies 14 and 16 may have on/off valves 22 and 24, pressure regulators 26 and 28, and pressure gauges 30 and 32, respectively. The gas torch 12 also may have a variety of flow control mechanisms for the oxygen and fuel. For example, the gas torch 12 may have oxygen and fuel valves 34 and 36 to control the flow rates of oxygen and fuel through the gas torch 12. In the illustrated embodiment, the gas torch 12 also has a high-pressure valve or trigger 38 to supply additional oxygen for a cutting application. However, as mentioned above, the gas torch 12 may embody any suitable configuration of oxygen and fuel supply components within the scope of the present technique.

Figure 2:
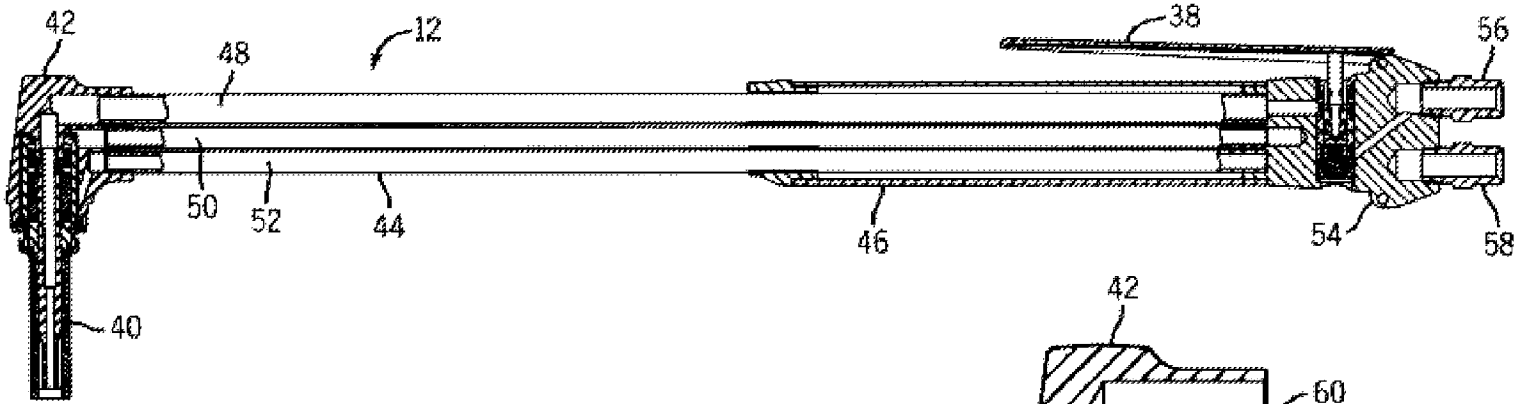
FIG. 2 is a cross sectional side view of an exemplary gas torch of the gas torch system illustrated in FIG. 1.

As illustrated in FIG. 2, the gas torch 12 comprises a tip 40 coupled to a head 42, which is coupled to a body 44. The body 44 of the gas torch 12 has a handle 46 disposed about a high-pressure oxygen passageway 48, an oxygen passageway 50, and a fuel passageway 52. It also should be noted that the oxygen and fuel passageways 50 and 52 may be adapted to transport preheated oxygen and fuel, respectively. At a flow regulating section 54 of the body 44, the gas torch 12 has oxygen and fuel line couplings 56 and 58 that are interlockable with the oxygen and fuel supply lines 18 and 20, respectively. As discussed above, the oxygen and fuel valves 34 and 36 control the flow rates of oxygen and fuel through the oxygen and fuel passageways 50 and 52. In a cutting application, the trigger 38 opens and closes the high-pressure supply of oxygen through the high-pressure oxygen passageway 48 to create a flame suitable for cutting.

At the head 42 of the gas torch 12, the high-pressure oxygen passageway 48 extends into a high-pressure oxygen inlet 60, while the oxygen and fuel passageways 50 and 52 extend into oxygen and fuel inlets 62 and 64, respectively. In the illustrated embodiment of FIG. 3, the oxygen and fuel inlets 62 and 64 feed the oxygen and fuel through a head-mountable flashback-arresting filter 66. After passing through the flashback-arresting filter 66, the oxygen and fuel mixes in the head 42, ejects from the tip 40, and forms a flame downstream of the tip 40. Upon engaging the trigger 38, the high-pressure oxygen also passes through the head 42, ejects from the tip 40, and enhances the flame for cutting. As illustrated, a hollow insert 67, which extends from a hollow center region of the flashback-arresting filter 66 through the tip 40, may completely isolate the oxygen and fuel from the oxygen and fuel inlets 62 and 64 from the high-pressure oxygen from the high-pressure oxygen inlet 60. Any suitable tip 40 may be used within the scope of the present technique.

Figure 4:
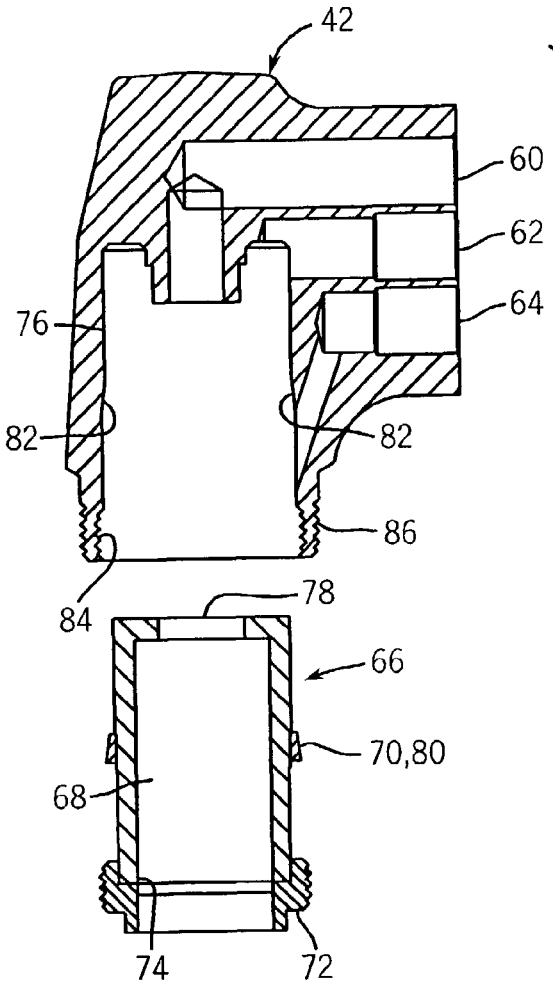
FIG. 4 is a cross sectional side view of an exemplary flashback-arresting filter exploded from the head section illustrated in FIG. 3.

FIG. 4 is a cross sectional side view of the flashback-arresting filter 66 exploded from the head 42. The flashback-arresting filter 66 functions to arrest flashback in the head 42 prior to its propagation and acceleration further upstream into the body 44, the oxygen and fuel lines 18 and 20, and so forth. In the illustrated embodiment, the flashback-arresting filter 66 has a generally annular filter structure 68, an outer seal or oxygen-fuel separator 70 disposed about the annular filter structure 68, and a threaded retainer 72 disposed at an end 74 of the annular filter structure 68. The various components of the flashback-arresting filter 66 may be formed from any suitable materials, such as stainless steel, copper, brass, and so forth. In one embodiment of the flashback-arresting filter 66, the annular filter structure 68 comprises stainless steel, the outer seal 70 comprises copper, and the threaded retainer 72 comprises brass.

The annular filter structure 68 may comprise a variety of filtering mechanisms, such as a porous metal filter. For example, the annular filter structure 68 may comprise a sintered metal filter element made of a particulate metal (e.g., a powdered stainless steel), which is pressed into shape and sintered to join the particulate metal into a porous metallic mass. However, any other suitable manufacturing process, such as metal injection molding, also may be used to form the annular filter structure 68. Given the random size, shape, and packing of the metal particles, the annular filter structure 68 has relatively random pores extending through the metallic mass. The particular size, direction, and characteristics of these random pores depend largely on the type of metal and manufacturing process used to create the annular filter structure 68. However, the foregoing random pores generally exhibit nonlinear passageways having relatively fine diameters, such as diameters less than 100 microns (e.g., 5-20 microns). In operation, these random pores cool and extinguish a flame front, i.e., flashback propagating back into the gas torch 12.

Figure 5:
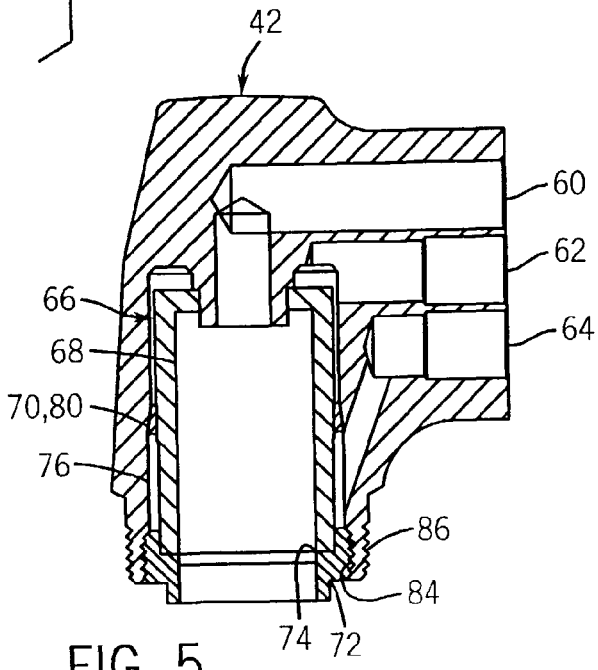
FIG. 5 is a cross sectional side view of the flashback-arresting filter disposed in the head section.

As illustrated in FIG. 5, the flashback-arresting filter 66 is insertable into a filter receptacle 76 of the head 42, such that the annular filter structure 68 is disposed adjacent the oxygen and fuel inlets 62 and 64. As mentioned above, the outer seal or oxygen-fuel separator 70 may be disposed between the oxygen and fuel inlets 62 and 64 to prevent mixing of the oxygen and fuel prior to its passage through the annular filter structure 68. The oxygen and fuel subsequently mixes downstream of the annular filter structure 68. The relatively fine porous nature of the annular filter structure 68 also reduces backflow of the oxygen-fuel mixture, thereby further reducing the potential risk of flashback upstream of the head 42. The outer seal 70 may be press-fit, shrink fit, snap-fit, or otherwise secured about the annular filter structure 68. For example, the annular filter structure 68 may have a groove to accept the outer seal 70. Alternatively, the annular filter structure 68 may have a variable diameter or wedge-shape to facilitate a compressive fit with the outer seal 70. The outer seal 70 also may have an outer wedge shape 80 that is sealable against a wedge section 82 in the filter receptacle 76. Any other suitable seal mechanism is within the scope of the present technique.

Figure 3:
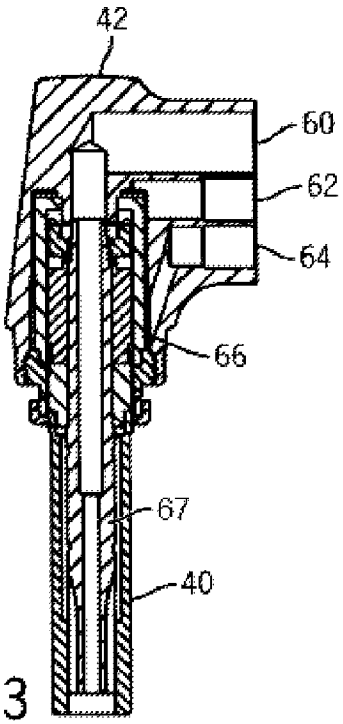
FIG. 3 is a cross sectional side view of exemplary head and tip sections of the gas torch illustrated in FIG. 2.

The high-pressure oxygen inlet 60 also may be sealed from the oxygen and fuel inlets 62 and 64 to prevent undesirable mixing upstream of the head 42. For example, the high-pressure oxygen inlet 60 may be coupled directly to the tip 40, e.g., through a passageway 78, such that the high-pressure oxygen does not mix with the oxygen and fuel from the inlets 62 and 64 until ejected from the tip 40. As illustrated in FIG. 3, the hollow insert 67 may ensure that the oxygen and fuel from the inlets 62 and 64 are completely isolated from the high-pressure oxygen.

As mentioned above and illustrated in FIG. 5, the flashback-arresting filter 66 also may be retained in the filter receptacle 76 via the threaded retainer 72. The threaded retainer 72 may be press-fit, shrink fit, snap-fit, or otherwise secured about the annular filter structure 68. For example, the annular filter structure 68 may have a groove to accept the threaded retainer 72. Alternatively, the annular filter structure 68 may have a variable diameter or wedge-shape to facilitate a compressive fit with the threaded retainer 72. Any other suitable attachment mechanism is within the scope of the present technique. In operation, the annular filter structure 60 may be secured tightly within the filter receptacle 76 by rotating the thread retainer 72 into internal threads 84 within the filter receptacle 76. Alternatively, the entire annular filter structure 68 may be compressively fit within the filter receptacle 76. An external retainer (not shown) also may be engaged with external retainer threads 86 to secure the tip 40 to the head 42.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. An industrial torch, comprising:

a torch body having oxygen and gas supply passages;

a torch head coupled to the torch body and comprising:

an interior cavity;

a flashback arrestor disposed in the interior cavity, comprising:

a body comprising a porous material having a hollow cylindrical shape having a hollow interior region; and a separator disposed about an exterior of the body, wherein a first annular region of the body is located on one side of the separator and a second annular region of the body is located on an opposite side of the separator; and an insert comprising a hollow region that extends through the flashback arrestor and into a torch tip, wherein the insert is disposed in the hollow interior region of the body of the flashback arrestor; and the torch tip coupled to the torch head, wherein the industrial torch comprises:

an oxygen path extending through the oxygen supply passage and through the first annular region of the body of the flashback arrestor;

a gas path extending through the gas supply passage and through the second annular region of the body of the flashback arrestor;

a gas mixing region downstream of the flashback arrestor in the oxygen and gas paths; and a high-pressure oxygen path extending through the hollow region of the insert such that high-pressure oxygen does not does not mix with the gas or the oxygen prior to egress from the torch tip.

2. An industrial torch, comprising:

a torch body having high-pressure oxygen, oxygen and gas supply passages;

a torch head coupled to the torch body and comprising a single flashback arrestor disposed in separate paths of high-pressure oxygen, oxygen and gas from the high-pressure oxygen, oxygen and gas supply passages, wherein the separate paths of oxygen and gas extend through the torch head to produce an oxygen-gas mixture downstream of the single flashback arrestor and in the torch head, wherein the single flashback arrestor comprises a porous material disposed in the separate paths of oxygen and gas, the single flashback arrestor comprises a seal disposed between the separate paths of oxygen and gas, and wherein the path of high-pressure oxygen is completely isolated from the path of oxygen and the path of gas in the flashback arrestor and does not pass through the porous material of the flashback arrestor; and a torch tip coupled to the torch head.

3. The industrial torch of claim 2, wherein the single flashback arrestor comprises a hollow insert.

4. The industrial torch of claim 2, wherein the single flashback arrestor comprises a porous metallic structure having nonlinear passageways.

5. The industrial torch of claim 4, wherein the porous metallic structure comprises a pressed and sintered metallic powder.

6. The industrial torch of claim 4, wherein the porous metallic structure comprises a metal injection molded filter.

7. The industrial torch of claim 4, wherein the porous metallic structure comprises random pores less than 100 microns in diameter.

8. The industrial torch of claim 2, wherein the seal comprises an annular metallic ring.

9. The industrial torch of claim 2, wherein the single flashback arrestor is adapted to prevent a flame from propagating beyond the torch head.

10. The industrial torch of claim 2, wherein the oxygen and gas supply passages are preheated supply passages.

11. The industrial torch of claim 2, wherein the torch body further comprises a high-pressure oxygen supply passage.

12. The industrial torch of claim 2, wherein the single flashback arrestor comprises a single cylindrical structure.

13. The industrial torch of claim 2, wherein the single flashback arrestor comprises a single hollow structure.

14. The industrial torch of claim 13, wherein the separate paths of oxygen and gas extend through walls of the hollow structure.

15. The industrial torch of claim 2, wherein the separate paths of oxygen and gas pass through different portions of the single flashback arrestor.

16. An industrial torch, comprising:

a torch body;

a torch head coupled to the torch body and comprising high-pressure oxygen, oxygen and gas supply passages and a single means for arresting a flame inside the torch head, wherein the oxygen and gas supply passages are directed independently into and independently through the single means for arresting, the high-pressure oxygen supply passage is directed through the torch head independent of and isolated from the oxygen and gas supply passages, and the torch head comprises means for sealing oxygen and gas flows apart from one another upstream of the single means for arresting the flame; and a torch tip coupled to the torch head.

17. The industrial torch of claim 16, wherein the oxygen and gas supplies are preheated supplies.

18. The industrial torch of claim 16, wherein oxygen and gas from the oxygen and gas supply passages mix downstream from the single means for arresting.

* * * * *